US005374111A

United States Patent [19]

Den Besten, deceased et al.

[11] Patent Number: 5,374,111

[45] Date of Patent: Dec. 20, 1994

[54] EXTRACTION UNDERCUT FOR FLANGED BITS

[75] Inventors: Leroy Den Besten, deceased, late of Valatie, N.Y., by Romona L. Den Bensten; Wayne H. Beach, Roaring Spring, Pa.

[73] Assignee: Kennametal Inc., Latrobe, Pa.

[21] Appl. No.: 53,114

[22] Filed: Apr. 26, 1993

[51] Int. Cl.[5] ..... E21C 35/18

[52] U.S. Cl. ..... 299/86; 299/91

[58] Field of Search ..... 299/86, 91, 79; 175/427

[56] References Cited

U.S. PATENT DOCUMENTS

| | | | |
|---|---|---|---|
| 3,268,260 | 8/1966 | Snipe | 299/91 |
| 4,149,753 | 4/1979 | Stoltz et al. | 299/91 |
| 4,251,109 | 2/1981 | Roepke | 299/12 |
| 4,298,233 | 11/1981 | Elfgen | 299/91 |
| 4,736,533 | 4/1988 | May et al. | 299/86 X |
| 4,938,538 | 7/1990 | Larsson et al. | 299/86 |
| 5,018,793 | 5/1991 | Den Besten | 299/86 |

FOREIGN PATENT DOCUMENTS

| | | | |
|---|---|---|---|
| 2948096 | 6/1981 | Germany | 299/91 |
| 3401243 | 8/1984 | Germany | 299/86 |
| 729796 | 12/1953 | United Kingdom | 299/91 |

*Primary Examiner*—David J. Bagnell

*Attorney, Agent, or Firm*—James G. Porcelli

[57] ABSTRACT

A cutting bit including a conical nose and an integral depending cylindrical shank. The conical nose includes a tip having a hard wear resistant insert and a flange positioned between the tip and the shank and having a diameter greater than the shank. The flange has a planar underside including at least one undercut extending radially inward from the exterior peripheral surface of the flange to provide in cooperation with the face of a cutting bit block a resistance surface for insertion of a tine of a cutting bit removal tool.

20 Claims, 2 Drawing Sheets

EXTRACTION UNDERCUT FOR FLANGED BITS

FIELD OF THE INVENTION

This invention relates to a cutting bit for use in mining and construction operations. More particularly, this invention relates to a rotatable cutting bit including an extraction undercut to assist in the removal of the cutting bit from a bore in a cutting bit block.

BACKGROUND OF THE INVENTION

Various styles of rotatable cutting bits for use in mining and construction operations are well known. For example, one common style of rotatable cutting bit useful in mining and construction operations has a generally conical shape working head having secured to the apex of the head by brazing an axially disposed insert of cemented tungsten carbide. Depending from the conical shape working head is a shank which is inserted into a bore within a cutting bit block.

During mining and construction operations the cutting bit is generally utilized in a machine having a power driven cutter wheel. The power driven wheel is mounted on a horizontal shaft with the plane of the wheel disposed vertically. The wheel has on its periphery an array of cutting bits mounted in a plurality of permanent cutting bit blocks adapted to hold the carbide tipped cutting bits. The cutting bit blocks typically include a bore of a cylindrical shape having a substantially cylindrical opening. The cutting bits are mounted generally tangentially on the peripheral rim of the supporting wheel so that through the rotation of the wheel about its axis, the cutting bits may attack the material to be broken up by the horizontal reach of the cutting bits operating in a vertical plane.

Exemplary of a cutting bit block and a cutting bit for use on a construction machine is U.S. Pat. No. 4,201,421. U.S. Pat. No. 4,201,421 discloses a cutting bit including a spring sleeve of cylindrical form with a slot extending the full length of the spring sleeve along substantially all of the shank of the cutting bit. The cutting bit is inserted shank first into the bore of the cutting bit block such that the spring sleeve frictionally engages the inside wall of the bore keeping the cutting bit in a working position on the rim of the wheel. During operation of the construction machine the cutting bits impact against a material to be worked thereby breaking the material into small fragments. As the cutting bits repetitively impact against the material to be worked, some of the small material fragments may work between the cutting bits and corresponding cutting bit blocks thereby wedging the cutting bits into the bore of the cutting bit blocks and preventing free rotation of the cutting bits and subsequent removal of the cutting bits from the bit blocks as required. The effect of the small material fragments pressed between the bit blocks and the cutting bits is that the removal of the cutting bits from the bit blocks is difficult, if not impossible, thereby necessitating increased machine downtime and expense.

Previously, a removal tool having a wedge shaped tine was driven between the conical cutting head and the bit block to pry the bit from the block. However, because the loose fragments of material are packed so tightly around the conical cutting head and the bit block, insufficient clearance is provided between the cutting head and the bit block for the removal tool to enter between the conical cutting head and the block.

To alleviate the aforementioned problems, we have invented a conical flanged cutting bit having a working head and a supporting shank depending therefrom. Formed integral with the base of the working head is an undercut. The undercut allows for the free insertion of a cutting bit removal tool to assist in the removal of the cutting bit from the socket mount. In a preferred embodiment, the undercut comprises opposing triangular cutouts to provide a variable reaction surface upon insertion of the bit removal tool within the undercut between the cutting bit and the cutting bit block.

Accordingly, one aspect of the present invention is to provide a conical flanged cutting bit including an undercut at the base of the conical flange to receive a bit removal tool. Another aspect of the present invention is to provide a conical flanged cutting bit including an undercut at the base of the conical flange to receive a bit removal tool that is simple and economical to manufacture.

SUMMARY OF THE INVENTION

Briefly, according to this invention, there is provided a flanged conical cutting bit including at least one tapered undercut to receive a bit removal tool. The cutting bit includes a conical nose and an integral depending cylindrical shank. The conical nose includes a flange portion of a diameter greater than the shank positioned between the conical nose and the shank. The flange portion is of a circular circumference and has a planar underside including at least one undercut extending radially inward from the exterior surface of the flange portion.

In a preferred embodiment, the undercuts are spaced in an opposing paired relationship about the planar underside of the flange portion of the cutting bit. The undercuts extend radially inwardly from the exterior of the periphery of the circumference of the planar underside of the flange to form triangular shaped undercuts having a curved hypotenuse equivalent to the curvature of the circumference of the flange.

In a preferred embodiment, the undercuts taper upwardly from the underside surface of the flange toward the conical nose of the cutting bit. The undercuts taper upwardly at an angle of approximately 15 degrees from a line extending transversely from a longitudinal axis of the cutting bit.

The present invention also contemplates, in combination, the cutting bit as previously described and a bit block for rotatably holding the cutting bit. The undercut and face of the bit block cooperatively provide a variable opposing resistance surface between the undercut and face of the bit block to receive a tine of a cutting bit removal tool.

BRIEF DESCRIPTION OF THE DRAWINGS

Further features and other aspects of this invention will become clear from the following detailed description made with reference to the drawings in which.

DESCRIPTION OF THE PREFERRED EMBODIMENTS

Figure 1:
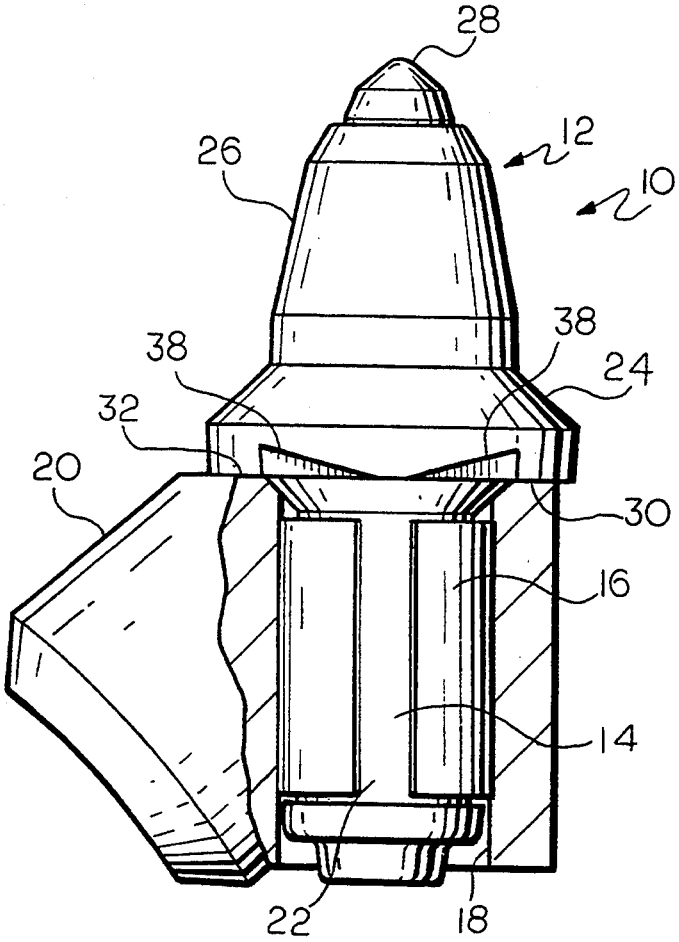
FIG. 1 is a partial fragmentary side view of a conical cutting bit in accordance with the present invention sealed within a cutting bit block.

Referring to the drawings in which the reference characters refer to similar parts throughout the several views, FIG. 1 illustrates a rotatable flanged cutting bit 10 in accordance with the present invention secured within a bore 18 of a bit block 20 which may be attached to a rotating drum of a mining or construction machine of a type well known in the art. The rotatable flanged cutting bit 10 includes a working head having a generally conically shaped nose portion 12 and a depending shank portion 14 having a reduced diameter section which is adapted to receive a split annular spring retainer 16 of a type well known in the art.

The shank 14 of the cutting bit 10 is that portion which is inserted into the bore 18 formed within the bit block 20. The shank 14 is of a circular cross-section and is formed integral with and depends from the conically shaped nose portion 12. The shank 14 includes an annular recess 22 formed intermediate the rearward end of the cutting bit and the conically shaped nose portion 12. The split annular retainer 16 surrounds the annular recess and fits slidably within the bore 18 of the bit block 20.

As shown in FIG. 1, the cutting bit 10 and spring retainer 16 are fully inserted in the bore 18 of the bit block 20 and the cutting bit is ready to be used for the desired function. The spring sleeve retainer 16 loosely embraces the shank 14 of the cutting bit 10 thereby maintaining the underside of the cutting bit flush with a flat bearing surface of the bit block 20. The spring sleeve retainer 16 exerts a strong hold on the inner surface of the bore 18 to resist axial movement of the cutting bit 10 as the cutter wheel previously described herein rotates.

The split spring retainer 16 is longitudinally slotted and is preferably made of a resilient metal such as AISI 1050 spring steel heat treated to Rockwell C 45-50. The split spring retainer should have sufficient resilience when it is contracted to produce an adequate holding force for retaining the spring retainer in position when disposed around the cutting bit within the bore 18.

As shown in FIGS. 1–4, the conical nose portion 12 of the cutting bit 10 includes a flange 24 and tip 26. The conical nose portion 12 of the cutting bit 10 diverges from the tip 26 of the cutting bit rearwardly to the flange 24 positioned intermediate the tip of the conical nose portion and the shank 14 of the cutting bit. Secured within the tip 26 of the cutting bit 10 is an insert 28. The insert 28 is preferably made of a cemented metal carbide such as cobalt tungsten carbide but may be made of any other material suitable for the intended purpose of the cutting bit 10. The shape of the insert 28 may be as shown or of any other known insert shape or composition as exemplified by U.S. Pat. Nos. 4,725,098; 4,497,520; 4,859,543.

The flange 24 of the cutting bit 10 is of a generally truncated frustoconical shape extending radially outward beyond the tip 26 of the conical nose portion 12 and terminating in a planar underside 30. It will be appreciated that the flange 24 of the cutting bit 10 protects the face 32 of the bit block 20 against premature wear from abrasion with the work surface. Formed within the planar underside 30 of the flange 24 are undercuts or recesses 34 to receive the tines of a bifurcated fork removing tool of a type well known in the art.

Although the present invention is illustrated in connection with a flanged cutting bit 10 having a split retainer 16, it will be appreciated that the present invention may be applied with equal facility to other types of cutting bits employing different retainer systems. For example, the teachings of the present invention may also be utilized with a U94KHD cutting bit employing a short retainer as sold by Kennametal Inc. Accordingly, the style of retainer to secure the flanged cutting bit within the cutting bit block or the type of flanged cutting bit is not a limitation on the practice of the present invention.

Figure 2:
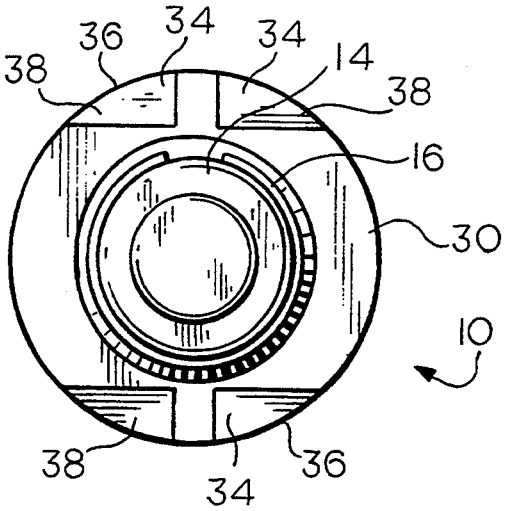
FIG. 2 is an end view of the conical cutting bit of FIG. 1.
Figure 3:
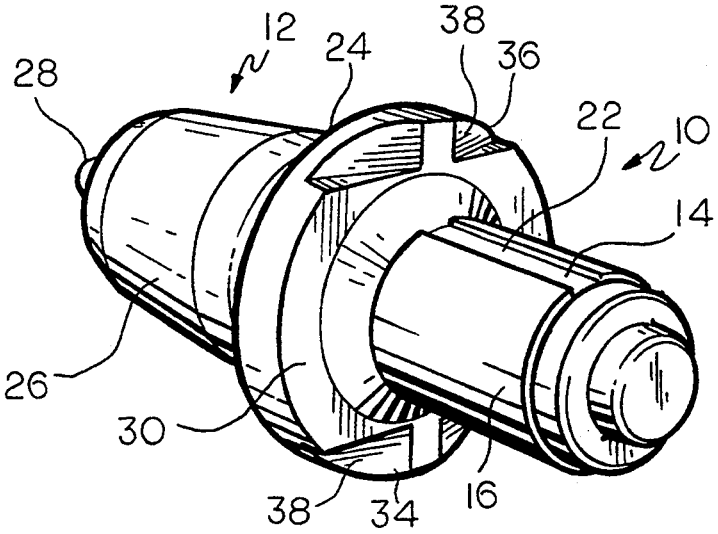
FIG. 3 is an isometric view of the conical cutting bit of FIG. 2.

The undercuts or recesses 34 may be of most any shape and size suitable to provide an opening between the planar underside 30 of the flanged cutting bit 10 and the face 32 of the bit block 20 when the cutting bit is seated within the bit block. As shown in FIGS. 1–3, the undercuts 34 extend radially inwardly from the exterior of the periphery of the circumference of the underside of the flange 24 to form triangular shaped undercuts in which the triangle hypotenuse 36 is also coincident with and follows the curvature of the circumference of the flange. The top surface 38 of the undercuts 34 taper upwardly from the underside planar surface 30 of the flange 24 toward the conical nose 12 of the cutting bit 10. The undercuts 34 may taper upwardly at an angle of approximately 15 degrees from the underside planar surface 30 of the cutting bit 10. The taper of the undercut 34 provides a variable opposing resistant surface between the undercut and the face 32 of the bit block 20 upon insertion of the tine of the removal tool within the opening formed between the bit block and the cutting bit.

Figure 4:
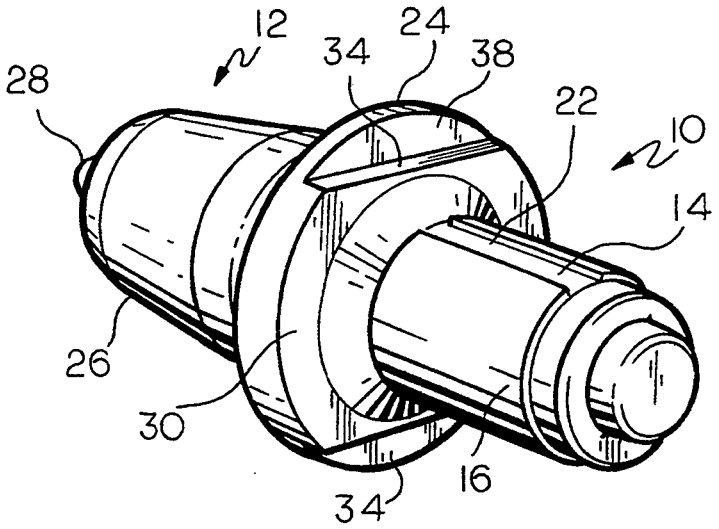
FIG. 4 is an isometric view of a conical cutting bit is accordance with another aspect of the present invention.

In an alternative embodiment of the present invention as shown in FIG. 4, the undercut or recess 34 may be of a generally arcuate shape having a planar top surface 38.

The undercuts 34 are arranged circumferentially about the underside of the flange 24 to provide sufficient surface area to uniformly support the rotating cutting bit 10 upon the opposing flat face 32 of the bit block 20 as the bit cuts a work surface. As shown in FIGS. 3 and 4, the undercuts 34 are arranged in a spaced opposing paired relationship about the underside of the flange 24 of the cutting bit 10.

Upon insertion of the cutting bit 10 into the bore 18 of the bit block 20, the underside planar base of the flange 24 is firmly seated upon the opposing face 32 of the bit block. The undercuts 34 in cooperation with the face 32 of the bit block 20 provide an opening which allows for the free insertion of the tines of a bit removal to extract the bit from the bit block without damaging the socket mount or the head of the cutting bit.

The documents, patents and patent applications referred to herein are hereby incorporated by reference.

Having described presently preferred embodiments of the invention, it is to be understood that it may be otherwise embodied within the scope of the appended claims.

What is claimed is:

1. A rotatable cutting bit comprising:

a conical nose and an integral depending cylindrical shank, said conical nose including a tip having a hard wear resistant insert and a flange positioned between said tip and said shank and having a diameter greater than said shank, said flange having a planar underside seated upon an opposing face of a bit block, said planar underside including at least one undercut extending radially inward from the exterior peripheral surface of said flange to a spaced distance from said shank.

2. The cutting bit of claim 1 wherein said undercut is of a generally arcuate shape having a planar top surface.

3. The cutting bit of claim 2 wherein said undercut includes a pair of undercuts spaced in an opposing paired relationship about said planar underside of said flange of the cutting bit.

4. The cutting bit of claim 3 wherein said flange has a circular circumference.

5. The cutting bit of claim 1 wherein said undercut includes a pair of undercuts spaced in an opposing paired relationship about said planar underside of said flange of the cutting bit.

6. The cutting bit of claim 5 wherein said flange has a circular circumference.

7. The cutting bit of claim 6 wherein said undercuts extend radially inwardly from the exterior of the periphery of the circumference of said planar underside of said flange to form triangular shaped undercuts having a hypotenuse which is coincident with and follows the curvature of the circumference of said flange.

8. The cutting bit of claim 7 wherein said undercuts taper upwardly from the underside surface of said flange toward said conical nose of the cutting bit.

9. The cutting bit of claim 8 wherein said undercuts taper upwardly at an angle of approximately 15 degrees from the planar underside of said flange.

10. The cutting bit of claim 9 wherein said flange is of a generally truncated frustoconical shape extending radially outward beyond said tip of said conical nose portion and terminating in a planar rearward end.

11. A rotatable cutting bit and bit block for rotatably holding said cutting bit, said rotatable cutting bit comprising a conical nose and an integral depending cylindrical shank, said conical nose including a tip having a hard wear resistant insert and a flange positioned between said tip and said shank and having a diameter greater than said shank, said flange seated upon an opposing face of said bit block and having a planar underside including at least one undercut extending radially inward from the exterior peripheral surface of said flange.

12. The cutting bit and bit block of claim 11 wherein said undercut is of a generally arcuate shape having a planar top surface.

13. The cutting bit and bit block of claim 12 wherein said undercut includes a pair of undercuts spaced in an opposing paired relationship about said planar underside of said flange of the cutting bit.

14. The cutting bit and bit block of claim 13 wherein said flange has a circular circumference.

15. The cutting bit and bit block of claim 13 wherein said undercuts in cooperation with said bit block provide an opening extending from the periphery of said flange portion radially inward.

16. The cutting bit and bit block of claim 15 wherein said undercuts are spaced in an opposing paired relationship about said planar underside of said flange portion of the cutting bit.

17. The cutting bit and bit block of claim 16 wherein said flange is of a circular circumference and said undercuts extend radially inwardly from the exterior of the periphery of the circumference of said planar underside of said flange to form triangular shaped undercuts having a hypotenuse which is coincident with and follows the curvature of the circumference of said flange.

18. The cutting bit and bit block of claim 17 wherein said undercuts taper upwardly from the underside surface of said flange toward said conical nose of the cutting bit.

19. The cutting bit and bit block of claim 18 wherein said undercuts taper upwardly at an angle of approximately 15 degrees from a line extending transversely from a longitudinal axis of the cutting bit.

20. The cutting bit and bit block of claim 19 wherein said flange is of a generally truncated frustoconical shape extending radially outward beyond said tip of said conical nose portion and terminating in a planar rearward end.

* * * * *